United States Patent [19]

Isobe et al.

[11] 4,278,060

[45] Jul. 14, 1981

[54] FEEDBACK TYPE AIR FUEL RATIO CONTROLLING SYSTEM

[75] Inventors: Toshiaki Isobe, Nagoya; Tatsuo Yokoyama, Kakogawa, both of Japan

[73] Assignee: Toyota Jidosha Kogyo Kabushiki Kaisha, Toyota, Japan

[21] Appl. No.: 169,986

[22] Filed: Jul. 18, 1980

Related U.S. Application Data

[63] Continuation of Ser. No. 942,801, Sep. 15, 1978, abandoned.

[30] Foreign Application Priority Data

May 2, 1978 [JP] Japan ..... 53-53086

[51] Int. Cl.[3] ..... F02M 7/00; F02B 3/00; F02B 75/10

[52] U.S. Cl. ..... 123/440; 123/437; 123/438; 73/26

[58] Field of Search ..... 123/437, 438, 440; 73/26, 27 R; 60/276, 285; 204/195 S, 15

[56] References Cited

U.S. PATENT DOCUMENTS

| | | | |
|---|---|---|---|
| 3,831,564 | 8/1974 | Schmidt et al. | 60/285 |
| 4,131,091 | 12/1978 | Asano et al. | 123/440 |
| 4,153,023 | 5/1979 | Asano et al. | 123/440 |
| 4,203,394 | 5/1980 | Aono et al. | 123/440 |

*Primary Examiner*—Charles J. Myhre
*Assistant Examiner*—R. A. Nelli
*Attorney, Agent, or Firm*—Cushman, Darby & Cushman

[57] ABSTRACT

A feedback type air fuel ratio controlling system for detecting and controlling an exhaust gas composition of an engine. A gas sensor provides a sensor signal related to an exhaust gas concentration. This sensor signal is coupled through an automatic gain control (AGC) DC level amplifier to a deviation detector. The deviation detector compares the signal to a reference signal $V_p$ representing a stoichiometric air fuel mixture and provides a correction signal for adjusting the engine's air fuel ratio. The AGC DC level amplifier provides automatic DC level compensation for a slowly deteriorating sensor and, working in combination with the deviation detector, an AC hysteresis response for judging rich to lean and lean to rich changes sensed by the exhaust gas sensor. When the output of the exhaust gas sensor varies slowly with respect to the time constant of the AGC DC amplifier, as with a deteriorating sensor, the DC level of the output voltage of the AGC DC amplifier is maintained substantially at a predetermined reference level Vs if the sensor signal coupled to the AGC DC amplifier is within a predetermined range. However, when the exhaust gas sensor output varies at a rate consistent with the time constant of the AGC DC level amplifier, a rich to lean change of the total air fuel ratio is detected at an earlier point in time than it would otherwise be detected in the absence of the AGC DC level amplifier by decreasing the gain of the AGC DC level amplifier and a lean to rich change of the total air fuel ratio is detected at an earlier point in time than it would otherwise be detected in the absence of the AGC DC level amplifier by increasing the gain of the AGC DC level amplifier.

21 Claims, 10 Drawing Figures

FEEDBACK TYPE AIR FUEL RATIO CONTROLLING SYSTEM

This is a continuation, of application Ser. No. 942,801 now abandoned filed Sept. 15, 1978.

BACKGROUND OF THE INVENTION

1. Field of the Invention

The present invention relates to a feedback type air fuel ratio controlling system in which exhaust gas composition concentrations in an engine are detected to feedback control supply amount of fuel or air to the engine to thereby maintain the air fuel ratio at a set value.

2. Description of the Prior Art

A feedback type air fuel ratio controlling system for controlling an air fuel ratio of a mixture of an internal combustion engine or an air fuel ratio of an exhaust gas flowing into an exhaust gas purifier disposed in the exhaust system of the engine, that is, a ratio between total amount of air and total amount of fuel which are supplied to a passage extending from the inlet system of the engine to the exhaust system of the engine just upstream side of the exhaust gas purifier (hereinafter referred to as a total air fuel ratio) in accordance with a detected actual total air fuel ratio has conventionally been known wherein the actual air fuel ratio of the engine detected from the exhaust gas composition concentrations is used to feedback control supply of fuel to the engine, supply of auxiliary air to the engine inlet system or supply of secondary air to the engine exhaust system for maintaining the actual total air fuel ratio of the engine within an extremely narrow range around a set value, whereby the exhaust gas may be purified. Especially, with an exhaust gas purifier in the form of a ternary or three-way catalytic converter, it is possible to simultaneously reduce amounts of three harmful compositions such as HC, CO and NOx contained in the exhaust gas by determining the aforementioned set value to the stoichiometric air fuel ratio. Such prior art feedback type air fuel ratio controlling systems will be described herein with reference to FIGS. 1 and 2. FIG. 1 shows a well known feedback type air fuel ratio controlling system, as disclosed in U.S. Pat. Nos. 3,903,853; 3,745,768; 4,020,813 and 3,960,118, for example, which controls the air fuel ratio of a mixture in the engine inlet system, that is, feedback controls supply amount of fuel or auxiliary air to the engine inlet system by using the detecting output of an exhaust gas sensor. The controlling system as shown in FIG. 1 comprises an internal combustion engine 10, an inlet manifold 11, an exhaust manifold 12, and an exhaust pipe 13. An exhaust gas sensor 14 is located at a portion of the exhaust pipe 13 for detecting the air fuel ratio. A three-way catalytic converter 15 is connected in the exhaust pipe 13 downstream of the exhaust gas sensor 14. A controlling circuit generally designated at 31 comprises a deviation detector circuit 16 having one input supplied with the output of the exhaust gas sensor 14 and another input supplied with the output of a reference value generator circuit 17 generating a reference value of a fixed level to produce a deviation signal in accordance with the magnitude of the output of exhaust gas sensor 14, that is, the magnitude of air fuel ratio, and an air fuel ratio correcting circuit 18 receiving the deviation output of the deviation detector circuit 16 to produce an air fuel ratio correcting signal containing an integrated component output and a proportional component output of the deviation signal. An actuator 19 receives the air fuel ratio correcting signal of the engine to control in accordance therewith amount of fuel or auxiliary air to be supplied into the inlet manifold 11. FIG. 2 shows another well-known feedback type air fuel ratio controlling system, as disclosed in Japanese Patent Application Laid Open No. 133412/'77, for example, in which the air fuel ratio of a mixture in the engine inlet system is previously adjusted to a slightly richer value than a set value and supply of secondary air to the engine inlet system is feedback controlled by using the output of an exhaust gas sensor. This controlling system comprises as shown in FIG. 2 an internal combustion engine 20, an inlet manifold 21, and an exhaust manifold 22 mounted with a secondary air distributor pipe 23 through which secondary air is supplied into the exhaust manifold. Numerals 13, 14 and 15 respectively designate an exhaust pipe, an exhaust gas sensor, and a three-way catalytic converter as in FIG. 1. A controlling circuit generally designated at 32 comprises a deviation detector circuit 16 similar to that of FIG. 1 while dispensed with the air fuel ratio correcting circuit 18 of FIG. 1. Connected between an air pump 28 driven by the engine and the secondary air distributor pipe 23 is a secondary air actuator 29 which receives the output of the controlling circuit 32 and controls in accordance therewith supply amount of the secondary air. It is appreciated that the secondary air actuator 29 may be also designed to perform the function of the air fuel correcting circuit 18 of FIG. 1. Turning to FIG. 3 showing an output characteristic of the exhaust gas seansor 14, it will be understood that the exhaust gas sensor 14 produces an output which is about 0.9 volts when the total air fuel ratio is richer than the stoichiometric air fuel ratio (corresponding to an excess air ratio $\lambda=1$) and is about 0.1 volts when the total air fuel ratio is leaner than the stoichiometric air fuel ratio ($\lambda=1$), and which varies abruptly around $\lambda=1$. Accordingly, by comparing the output of the exhaust gas sensor 14 with a reference value $V_R$ of about 0.5 volts, it is possible to detect whether the total air fuel ratio is richer or leaner than the stoichiometric air fuel ratio representative of a target air fuel ratio of the three-way catalytic converter 15. Thus, since the actuator 19 of FIG. 1 is operated through the air fuel ratio controlling circuit 18 or the secondary air actuator 29 of FIG. 2 is operated in accordance with a result of the aforementioned comparison, supply amount of air is increased or supply amount of fuel is decreased to cause the total air fuel ratio to turn to a lean value when the detected total air fuel ratio is richer than the target value whereas supply of air is decreased or supply of fuel is increased to cause the total air fuel ratio to turn to a rich value where the detected total air fuel ratio is leaner than the target value, thereby making it possible to maintain the total air fuel ratio within a narrow range around the target value. In this process, it takes some time for the exhaust gas sensor 14 to detect a resultant total air fuel ratio corrected by the actuator 19 or the secondary air actuator 29 because a time (hereinafter referred to as a transportation delay) is required of the mixture or the exhaust gas for its movement from a location at which the actuator 19 or the secondary air actuator 29 is placed to a location at which the exhaust gas sensor 14 is placed and because the exhaust gas sensor 14 has an inherent detection delay, resulting in a time delay responsible for a cyclic variation in the total air fuel ratio within a width about the center of the target air fuel ratio. This variation is illustrated in FIG. 4 where the abscissa represents time, solid curve A an output of the exhaust gas sensor 14, solid curve B a total air fuel ratio at the location at which the actuator 19 or the secondary air actuator 29 is placed, $V_R$ a reference value, $\lambda=1$ a level representative of a target value, that is, the stoichiometric air fuel ratio, $T_{AL}$ a time delay required of the exhaust gas sensor 14 starting from a time when the total air fuel ratio turned lean at the location at which the actuator 19 or the secondary air actuator 29 is placed to a time when the exhaust gas sensor 14 detects it, that is, a time delay required of the output of exhaust gas sensor 14 for its decrease below $V_R$, and $T_{AR}$ a time delay required of the exhaust gas sensor 14 starting from a time when the total air fuel ratio turned rich at the location at which the actuator 19 or the secondary air actuator 29 is placed to a time when the exhaust gas sensor 14 detects it, that is, a time delay required of the output of exhaust gas sensor 14 for its increase beyond $V_R$. The gradient of solid curve B corresponds to an air fuel ratio changing rate (a controlling gain) which is determined by a characteristic of the air fuel ratio correcting circuit 18 or that of the secondary air actuator 29. Further, an air fuel ratio variation width $\Delta\lambda_A$ is determined by both the air fuel ratio changing rate and the time delays $T_{AL}$ and $T_{AR}$. As seen from FIG. 4, as the air fuel ratio changing rate and time delays $T_{AL}$ and $T_{AR}$ become small, the air fuel ratio variation width becomes small correspondingly, thereby ensuring that the exhaust gas purifier can be operated effectively.

Incidentally, it is known in the art that the time delays $T_{AL}$ and $T_{AB}$ can be decreased to $T_{BL}$ and $T_{BR}$, respectively, by setting a higher level $V_1$ than $V_R$, at which level $V_1$ the exhaust gas sensor 14 detects a change of rich air fuel ratio to a lean air fuel ratio, and a lower level $V_2$ than $V_R$, at which level $V_2$ the exhaust gas sensor 14 detects a change of a lean air fuel ratio to a rich air fuel ratio. In this expedient, the output of exhaust gas sensor 14 varies as shown at dotted curve C in FIG. 4 and the total air fuel ratio varies as shown at dotted curve D in FIG. 4. Thus, the air fuel ratio variation width $\Delta\lambda_A$ is decreased to $\Delta\lambda_B$, ensuring that the exhaust gas purifier cam be operated with higher efficiency.

A feedback type air fuel ratio controlling system having the ability of providing the reference value, with which the output of exhaust gas sensor is compared, with a hysteresis characteristic is known, as disclosed in Japanese patent application Laid Open No. 114821/'77, for example. In this prior art controlling system, three types of conditions are judged including the exhaust gas sensor output being either above or below $V_R$, the exhaust gas sensor output being either in increase or in decrease, and the exhaust gas sensor output being either within $\pm\Delta V$ range about the center of $V_R$ or not ($V_R+\Delta V$ corresponding to $V_1$ and $V_R-\Delta V$ corresponding to $V_2$), and these conditions are processed by logical circuits to obtain the aforementioned hysteresis characteristic. With this prior art controlling system, however the number of detecting conditions are so large that complicated logical circuits are required. Further, in the event that the exhaust gas sensor is aged or subjected to varying ambient temperatures and its output assumes a waveform as shown at chained curve E in FIG. 4, failure to obtain the hysteresis characteristic results with such a problem that only a differentiation value of the exhaust gas sensor output permits the feedback controlling to be performed.

SUMMARY OF THE INVENTION

The present invention intends to eliminate the above drawbacks of the prior art controlling systems and has for its object to provide a feedback type air fuel ratio controlling system capable of steadily obtaining the hysteresis characteristic with a simple circuit construction irrespective of variations in the output characteristic of exhaust gas sensor. The invention is characterized in that the output of exhaust gas sensor is delivered to the deviation detector circuit through an automatic gain control amplifier (hereinafter referred to as an AGC amplifier) which can change its amplification degree at a given time constant and keep constant or the same the output thereof irrespective of variations in the exhaust gas sensor output.

According to the invention, when the output of exhaust gas sensor varies slowly as compared with the amplification degree changing time constant of the AGC amplifier, the output voltage of the AGC amplifier is maintained at a predetermined reference voltage if the sensor output voltage to the AGC amplifier exceeds a given value, whereas when the exhaust gas sensor output varies rapid as compared with the time constant, a rich to lean change of the total air fuel ratio is detected at an earlier time point by decreasing the amplification degree and a lean to rich change of the total air fuel ratio is detected at an earlier time point by increasing the amplification degree, whereby the input to the deviation detector circuit may have a hysteresis characteristic.

The invention ensures that the input to the deviation detector circuit can be provided with the hysteresis characteristic even when the exhaust gas sensor is aged or subjected to ambient temperature variations and its maximum output is decreased.

The invention will be described in more detail by referring to the accompanying drawings.

DESCRIPTION OF THE PREFERRED EMBODIMENT

Figure 5:
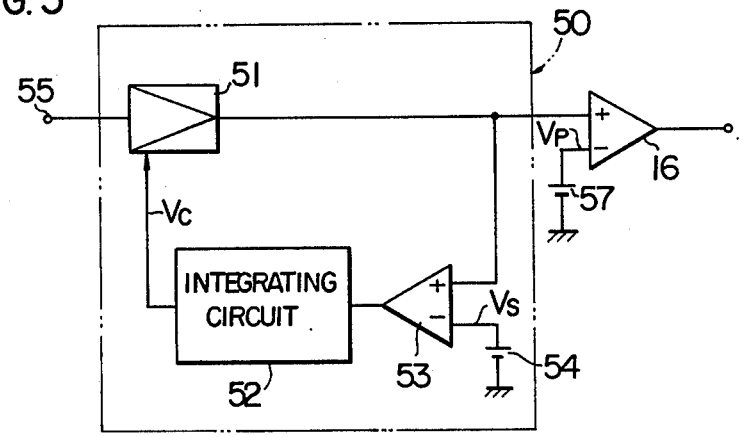
FIG. 5 is a block diagram of one embodiment of the invention.
Figure 6:
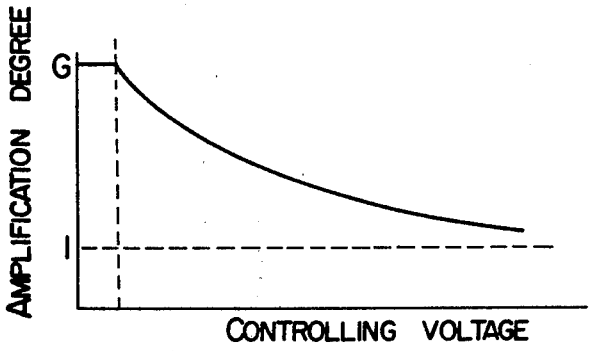
FIG. 6 is a graph showing a relation between the amplification degree of an AGC amplifier and the controlling voltage.

The invention will be described by way of an example with reference to FIGS. 5 to 10. Referring first to FIG. 5 showing a controlling circuit embodying the invention, there is shown an AGC amplifier 50 having an input terminal 55. The input terminal 55 receives an output signal from an exhaust gas sensor 14. A variable gain amplifier 51 changes its amplification degree in accordance with the magnitude of a controlling voltage $V_c$ delivered from an integrating circuit 52, as shown in FIG. 6. In FIG. 6, the maximum amplification degree of the variable gain amplifier is designated at G. There are also shown a comparator circuit 53 and a reference voltage generator 54 delivering a reference voltage $V_s$. The comparator circuit 53 compares the output voltage of the variable gain amplifier 51 with the reference voltage $V_s$ to deliver a high level voltage signal to the integrating circuit 52 when the output voltage of variable gain amplifier 51 exceeds the reference voltage $V_s$ and a low level voltage signal when the output voltage of variable gain amplifier 51 falls below the reference voltage $V_s$. When the integrating circuit 52 receives the high level voltage signal, that is, when the output voltage of variable gain amplifier 51 exceeds the reference voltage $V_s$, the integrating circuit 52 increases the controlling voltage $V_c$ delivered to the variable gain amplifier 51 gradually at a time constant specific to the integrating circuit 52, thereby gradually decreasing the amplification degree of variable gain amplifier 51.

On the other hand, when the integrating circuit 52 receives the low level voltage signal, that is, when the output voltage of variable gain amplifier 51 falls below the reference voltage $V_s$, the controlling voltage $V_c$ delivered to the variable gain amplifier 51 is decreased gradually at the specific time constant to thereby increase the amplification degree of variable gain amplifier 51 gradually. Accordingly, when the input voltage to the variable gain amplifier 51 varies slowly as compared to the time constant of integrating circuit 52, the output voltage of the variable gain amplifier 51 is fixed at the same value as the reference voltage $V_s$ regardless of the magnitude of the input voltage.

Figure 7:
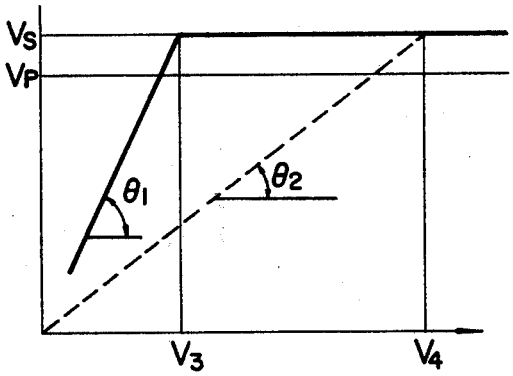
FIG. 7 is a graphic representation showing a static characteristic of the AGC amplifier.

This characteristic is shown in FIG. 7, where the abscissa represents the input voltage to the variable gain amplifier 51, that is, the output signal from the exhaust gas sensor 14 and ordinate represents the output voltage of variable gain amplifier 51. A gradient $\theta_1$ corresponds to the maximum amplification degree of variable gain amplifier 51. Accordingly, when the exhaust gas sensor output is below $V_3$, the output of variable gain amplifier 51 does not reach the reference voltage $V_s$, having a value corresponding to a product of the exhaust gas sensor output and maximum amplification degree $\theta_1$. When the exhaust gas sensor output exceeds $V_3$, the output voltage of variable gain amplifier 51 is fixed at the reference voltage $V_s$ as mentioned above in view of the static characteristic. In other words, for an output of the exhaust gas sensor of a value $V_4$, the amplification degree of variable gain amplifier 51 is decreased to a value $\theta_2$.

Figure 1:
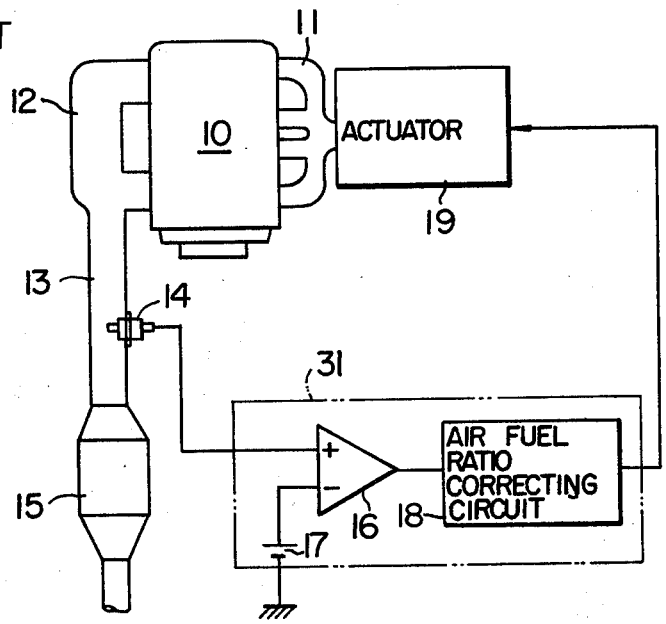
FIG. 1 PRIOR ART
FIG. 1 is a schematic diagram of a prior art feedback air fuel ratio controlling system in which an fuel ratio of a mixture in the engine inlet system is controlled.
Figure 2:
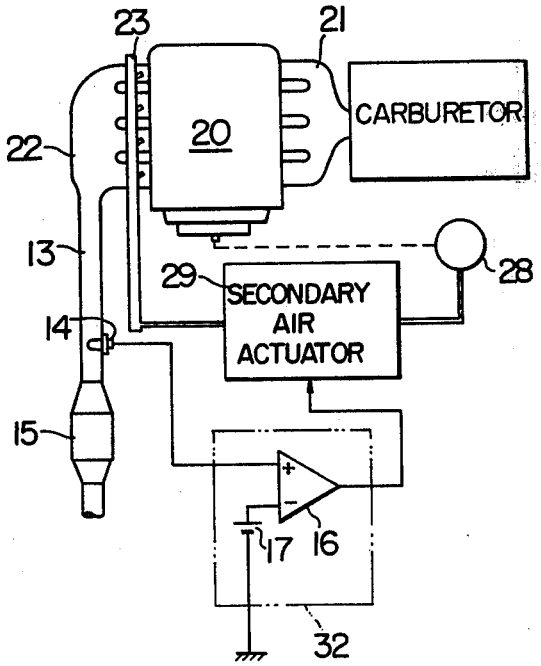
FIG. 2 PRIOR ART
FIG. 2 is a schematic diagram of another prior art feedback air fuel ratio controlling system in which supply of secondary air to the engine exhaust system is feedback controlled by the detecting output of an exhaust gas sensor.
Figure 3:
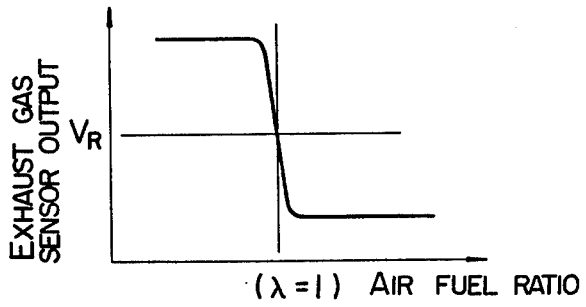
FIG. 3 is a graph showing an output characteristic of the exhaust gas sensor.

The output voltage from the variable gain amplifier 51 is fed to one input terminal (non-inverting input terminal) of the deviation detector circuit 16. Supplied to the other input terminal (inverting input terminal) of the deviation detector circuit 16 is a fixed level reference value $V_p$ delivered from a reference value generator circuit 57. The value $V_p$ is smaller than the reference voltage $V_s$, being preferably 80 to 90% of $V_s$. The output of deviation detector circuit 16 is sent to the actuator 19 through the air fuel ratio correcting circuit 18 or directly to the secondary air actuator 29 as illustrated in FIGS. 1 and 2 for the purpose of correcting the total air fuel ratio.

Figure 8:
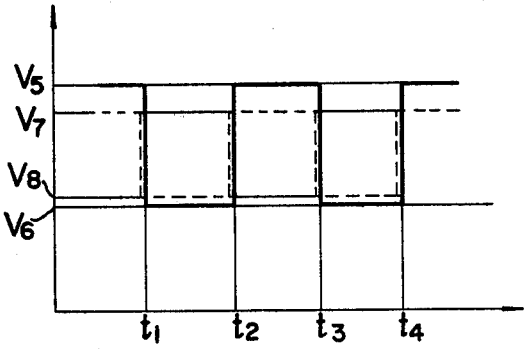
FIG. 8 is a graphic representation showing the exhaust gas sensor output varying with time when assumed as a rectangular wave.
Figure 9:
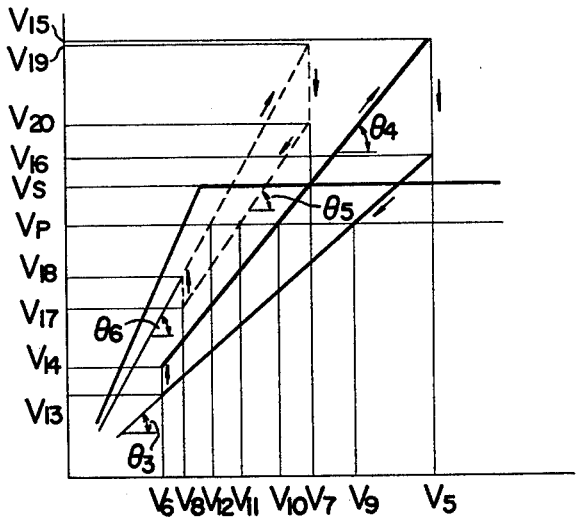
FIG. 9 is a graphic representation showing output characteristics of the AGC amplifier when the exhaust gas sensor output varies as in FIG. 8.

The operation of AGC amplifier 50 when the output voltage of exhaust gas sensor varies rapidly as compared to the time constant of integrating circuit 52 will be described with reference to FIGS. 8 and 9. For simplicity of explanation, the output signal of exhaust gas sensor 14 received by the input terminal 55 is assumed to be a rectangular wave as shown in FIG. 8. In the first case where the output of exhaust gas sensor 14 varies between a maximum $V_5$ and a minimum $V_6$ as shown by the heavy solid line in FIG. 8, because of a high level of the maximum $V_5$, the amplification degree of variable gain amplifier 51 is decreased to about a value of $\theta_3$ to $\theta_4$, as will be explained later. At time $t_1$, the output of exhaust gas sensor 14 decreases stepwise from $V_5$ to $V_6$. Concurrently therewith, the output of variable gain amplifier 51 decreases to $V_{13}$ below the reference voltage $V_s$ so that the output of integrating circuit 52 is decreased gradually with gradual increase of the amplification degree of variable gain amplifier 51 from $\theta_3$ to $\theta_4$, causing the variable gain amplifier to produce an output which increases gradually from $V_{13}$ to $V_{14}$. At time $t_2$, the outut of exhaust gas sensor 14 increases stepwise from $V_6$ to $V_5$ with stepwise increase of the output of variable gain amplifier 51 from $V_{14}$ to $V_{15}$. Thereafter, the output of variable gain amplifier 51 exceeding the reference voltage $V_s$ causes the output signal $V_c$ of integrating circuit 52 to increase gradually so that the amplification degree of variable gain amplifier 51 decreases gradually from $\theta_4$ to $\theta_3$ with gradual decrease of the output signal of variable gain amplifier 51 from $V_{15}$ to $V_{16}$. At time $t_3$, the output signal of exhaust gas sensor 14 decreases stepwise from $V_5$ to $V_6$ and the output of variable gain amplifier 51 again falls below the reference voltage $V_s$ to repeat the aforementioned operation. Accordingly, the output signal of variable gain amplifier 51 traces clockwise a solid line loop shown in FIG. 9. The deviation detector circuit 16 compares this output of variable gain amplifier 51 with the reference value $V_p$, and judges a lean state corresponding to a time interval starting from a time at which the output of variable gain amplifier 51 decreases below the reference value $V_p$, namely, the output of exhaust gas sensor 14 decreases below $V_9$ and ending at a time at which the output of variable gain amplifier 51 increases to the reference value $V_p$, namely, the output of the exhaust gas sensor again increasing reaches $V_{10}$, and a rich state corresponding to a time interval starting from a time at which the output of variable gain amplifier 51 exceeds $V_p$, namely, the increasing output of exhaust gas sensor 14 exceeds $V_{10}$ and ending at a time at which the output of the exhaust gas sensor again decreasing reaches $V_9$. In this manner, it is possible to make lower a sensor output comparison level for the increasing output of exhaust gas sensor 14 than that for the decreasing output of exhaust gas sensor 14, that is, to provide the aforementioned hysteresis characteristic.

On the other hand, in the case where the exhaust gas sensor 14 is aged or subjected to ambient temperature variations and its output assumes a dotted waveform in FIG. 8 which varies between a maximum $V_7$ and a minimum $V_8$, because of a low level of the maximum $V_7$ of exhaust gas sensor output, the amplification degree of variable gain amplifier 51 approximates a maximum extremity of about $\theta_5$ to $\theta_6$ to be described later. At time $t_1$, the output of exhaust gas sensor 14 decreases stepwise from $V_7$ to $V_8$. Since the output of variable gain amplifier 51 is $V_{17}$ at this time which is lower than the reference voltage $V_s$, the output of integrating circuit 52 decreases gradually with gradual increase of the amplification degree of variable gain amplifier 51 from $\theta_5$ to $\theta_6$, resulting in gradual increase of the output of variable gain amplifier 51 from $V_{17}$ to $V_{18}$. At time $t_2$, the output of exhaust gas sensor 14 increases stepwise from $V_8$ to $V_7$ with stepwise increase of the output of variable gain amplifier 51 from $V_{18}$ to $V_{19}$. Thereafter, the output of variable gain amplifier 51 exceeding the reference voltage $V_s$ causes the output signal $V_c$ of integrating circuit 52 to increase gradually so that the amplification degree of variable gain amplifier 51 decreases gradually from $\theta_6$ to $\theta_5$ with gradual decrease of the output signal of variable gain amplifier 51 from $V_{19}$ to $V_{20}$. At time $t_3$, the output signal of exhaust gas sensor 14 decreases stepwise from $V_7$ to $V_8$ and the output signal of variable gain amplifier 51 again decreases below the reference voltage $V_s$ to repeat the aforementioned operation. Accordingly, the output signal of variable gain amplifier 51 traces clockwise a dotted line loop shown in FIG. 9. Thus, in a similar manner to the solid line loop tracing, the deviation detector circuit 16 produces a lean signal when the output of exhaust gas sensor 14 is below $V_{11}$ and a rich signal when the output of exhaust gas sensor 14 exceeds above $V_{12}$. The value $V_{11}$ has a higher level than that of $V_{12}$ so that even when the exhaust gas sensor 14 is aged or subjected to ambient temperature variations and its output is varied thereby, the hysteresis characteristic can be obtained.

Figure 4:
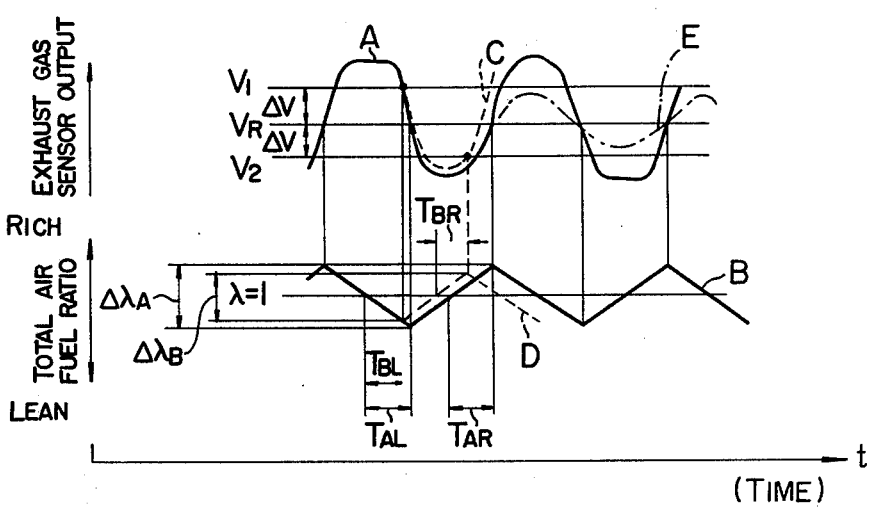
FIG. 4 is a graphic representation showing exhaust gas sensor output and total air fuel ratio varying with time.
Figure 10:
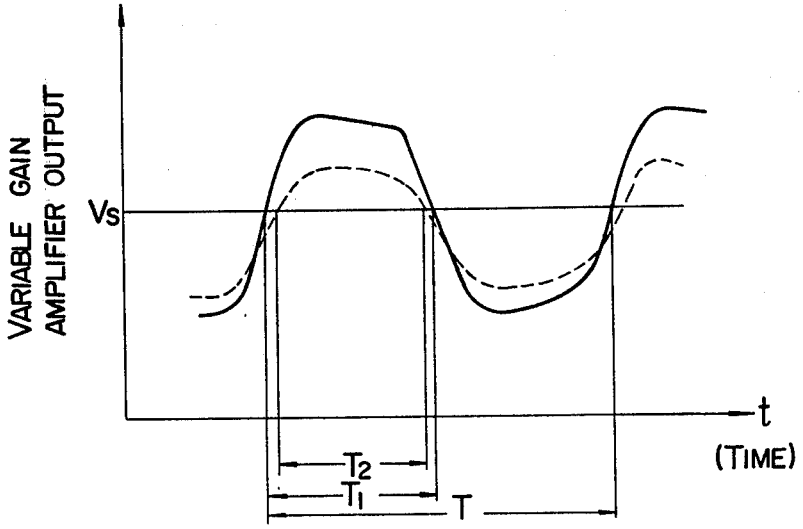
FIG. 10 is a graphic representation showing an output signal of AGC amplifier varying with time.

Turning now to FIG. 10, variations in the amplification degree of variable gain amplifier 51 which depend on variations in the maximum value of the exhaust gas sensor output will be described. FIG. 10 shows the output signal of variable gain amplifier 51 varying with time. Actually, the output of exhaust gas sensor 14 will not take the form of a complete rectangular waveform as shown in FIG. 8 but will be of a smoothly undulant waveform as shown at A, C and E in FIG. 4. Obviously, the output signal of variable gain amplifier follows a similar smoothly undulant waveform. In FIG. 10, a solid curve illustrates the output signal of variable gain amplifier 51 when the variable gain amplfier 51 is amplifying the output of exhaust gas sensor 14 at a fixed average amplification degree. Since it is now assumed that the average amplification degree of variable gain amplifier 51 remains unchanged, if the output signal varies at a period of T, a time interval $T_1$ during which the output signal is above the reference voltage $V_s$, namely, the amplification degree is decreased at a given time constant may equal a time interval $(T-T_1)$ during which the output signal is below the reference voltage $V_s$, namely, the amplification degree is increased at a given time constant. Accordingly, $T_1=\frac{1}{2}T$ holds. In the event that the exhaust gas sensor 14 is aged or subjected to ambient temperature variations and its maximum output is decreased, the output of variable gain amplifier 51 will assume a dotted waveform in FIG. 10 if the average amplification degree of variable gain amplifier 51 remains unchanged. In this case, a time interval during which the output signal of variable gain amplifier 51 is above the reference voltage $V_s$ becomes $T_2$ which is less than $T_1$ as will be seen from the figure. Accordingly, this time interval $T_2$ during which the amplification degree is decreased at a fixed time constant is made smaller than a time interval $(T-T_2)$ during which the amplification degree is increased at a fixed time constant and hence the average amplification degree is increased. In this manner, as the maximum output of exhaust gas sensor 14 decreases, the average amplification degree of variable gain amplifier 51 is increased automatically; and as the maximum output of exhaust gas sensor 14 increases, the average amplification degree of variable gain amplifier 51 is conversely decreased.

As has been described, the invention ensures that the comparison level of the exhaust gas sensor output can be provided with the hysteresis characteristic irrespective of variations in the output characteristic of exhaust gas sensor 14 and the exhaust gas purifier in the output system can be operated effectively.

We claim:

1. A feedback type air fuel ratio controlling system comprising:

an exhaust gas sensor for supplying a sensor signal representative of an air fuel ratio, an automatic gain control (AGC) DC level amplifier having a gain changeable at a predetermined time constant in response to said sensor signal of said sensor, including:

a variable gain DC amplifier having a signal input coupled to said sensor signal, an output, and a control input for controlling its gain, said variable gain DC amplifier being responsive to said sensor signal so as to (a) decrease its gain in accordance with said predetermined time constant when the output of said variable gain DC amplifier is greater than a fixed predetermined reference signal Vs so that a rich to lean change of air fuel ratio is detected earlier than it would be in the absence of such a gain change, and (b) increase its gain in accordance with said predetermined time constant when the output of said variable gain DC amplifier is less than Vs so that a lean to rich change of air fuel ratio is detected earlier than it would be in the absence of such a gain change, a comparator having a first input coupled to the output of said variable gain amplifier and a second input adapted to be coupled to a source of said reference signal Vs said comparator for producing a first signal whenever the output of said variable gain amplifier is greater than Vs and a second signal whenever the output of said variable gain amplifier is less than Vs, and an integrator having an input coupled to the output of said comparator, for generating an output signal Vc, responsive to said first and second signals, said output signal Vc being coupled to said control input of said variable gain amplifier whereby the gain of said variable gain amplifier is controlled in accordance with the time constant of said integrator and the output signals of said comparator, a deviation detector circuit for comparing the output of said automatic gain control DC level amplifier with a fixed reference signal Vp representing a stoichiometric air fuel ratio to produce a deviation signal, and an actuator for controlling the air fuel ratio in response to the deviation signal.

2. In a feedback type air fuel ratio controlling system comprising an exhaust gas sensor for supplying a sensor signal representative of an air fuel ratio, a deviation detector circuit for comparing the output of the sensor with a first reference signal Vp, representing a stoichiometric air fuel ratio, to produce a correcting signal, and an air fuel ratio correcting circuit responsive to the correcting signal, the improvement comprising:

an automatic gain control DC level amplifier connected between the exhaust gas sensor and the deviation detector circuit and having a gain changeable at a predetermined time constant in response to the output signal of said sensor, the output of said automatic gain control AGC DC level amplifier for being compared with said first reference voltage Vp, said AGC DC level amplifier changing its gain at said predetermined time constant so as to (a) decrease when the output of said AGC DC level amplifier is greater than a second reference level Vs so that a rich to lean change of air fuel ratio is detected earlier than it would be in the absence of such a gain change, and (b) increase when the output of said AGC DC level amplifier is less than said second reference level Vs so that a lean to rich change of air fuel ratio is detected earlier than it would be in the absence of such a gain change.

3. An improvement according to claim 2, wherein said automatic gain control amplifier includes a reference voltage generator circuit for generating said second reference level Vs.

4. An improvement according to claim 3, wherein said automatic gain control amplifier includes a variable gain DC level amplifier for amplifying said sensor signals to provide an amplified signal, a comparator circuit for comparing the amplified signal with said second reference signal Vs to produce an error signal, and an integrating circuit responsive to the error signal for controlling the gain of said variable gain amplifier at said predetermined time constant.

5. An improvement according to either of claims 3 or 4, wherein said second reference voltage Vs is selected from a range of $0.8\ Vs \leqq Vp \leqq 0.9\ Vs$.

6. An improvement according to either of claims 3 or 4, wherein the parameters of said automatic gain are established such that when said exhaust gas sensor is deteriorated and its output is decreased thereby from a first range to a second image, said automatic gain control amplifier operates substantially at its maximum gain to compensate for the difference in magnitude between said ranges.

7. A feedback type air fuel ratio controlling system comprising an exhaust gas sensor for detecting gas composition concentrations, a controlling circuit receiving a detecting output signal of said exhaust gas sensor to produce an air fuel ratio controlling signal, and an actuator receiving the air fuel ratio controlling signal and responsive thereto to correct a total air fuel ratio to a target value, said controlling circuit comprising:

an automatic gain control DC level amplifier having a gain changeable at a predetermined time constant for receiving an output signal of said exhaust gas sensor and for providing an amplified signal responsive thereto, the gain of said automatic gain control DC level amplifier being responsive so as to (a) decrease in accordance with said predetermined time constant when the output of said variable gain DC amplifier is greater than a predetermined reference level so that a rich to lean change of air fuel ratio is detected earlier than it would be in the absence of such a gain change, and (b) increase in accordance with said predetermined time constant when the output of said variable gain DC amplifier is less than a predetermined reference level so that a lean to rich change of air fuel ratio is detected earlier than it would be in the absence of such gain change;

a reference value generator circuit for producing reference value of a fixed level, and a deviation detector circuit for comparing and judging the output of said automatic gain control amplifier with the reference value.

8. A feedback type air fuel ratio controlling system comprising:

an exhaust gas sensor for supplying an output signal representative of an air fuel ratio;

an automatic gain control amplifier coupled to the output of said exhaust gas sensor and having an automatic hysteresis characteristic for automatically dynamically adjusting the gain of the automatic gain control amplifier so as to subject signals representing a rich to lean change of air fuel ratio to a greater gain than signals representing a lean to rich change of air fuel ratio and for automatically altering the range of the dynamic hysteresis characteristic to compensate for gas sensor deterioration;

a deviation detector for comparing the output of said automatic gain control amplifier with a fixed referenced voltage (Vp) to produce a deviation signal; and an actuator for controlling the air fuel ratio in response to the deviation signal.

9. In a feedback air fuel ratio controlling system of the type including an exhaust gas sensor for providing a sensor signal indicative of a sensed air fuel ratio, a lean-rich detector for comparing the sensor signal with a first reference signal Vp representing a stoichiometric air fuel ratio and providing an air fuel ratio correcting signal responsive to the deviation of the sensor signal from the reference signal, and an air fuel ratio correcting circuit responsive to the correcting signal for controlling the air fuel ratio, an improvement comprising:

an automatic gain control (AGC) DC level amplifier coupling the output of said sensor to the input of said lean-rich detector, the gain of said AGC DC level amplifier being changeable at a predetermined time constant, said amplifier providing a variable gain changing at said predetermined time constant up to a maximum gain, to generate an amplified output of the sensor signal when the sensor signal is within a predetermined range, said AGC DC level amplifier responding to sensor signals varying slowly with respect to said time constant by changing its gain at said predetermined time constant so as to provide a predetermined nominal DC level output Vs, said AGC DC level amplifier also responding to said sensor signals on a cycle by cycle basis to decrease its gain when the amplified output is greater than Vs and to increase its gain when the amplified output is less than Vs, said lean-rich detector being coupled to the output of said amplifier for comparing said first reference signal Vp and amplified output to generate the correcting signal;

whereby said AGC DC level amplifier by virtue of its gain change causes an earlier generation of said correcting signal to cause an earlier correction of air fuel ratio deviated from the stoichiometric air fuel ratio.

10. An improvement according to claim 9, wherein said AGC DC level amplifier comprises:

a variable gain DC level amplifier for amplifying said sensor signal, a reference voltage generator for generating a second reference signal having a magnitude Vs;

a comparator for comparing the amplified output signal of said variable gain DC level amplifier with said reference signal to generate a first signal when said amplified output is higher than said voltage Vs and to generate a second signal when said amplified output is lower than said second voltage; and an integrator responsive to said comparator for generating a third signal for decreasing the gain of said amplifier circuit in response to said first signal and for generating a fourth signal for increasing the gain of said amplifier circuit in response to said second signal said increasing or decreasing gain occurring at said predetermined time constant.

11. A feedback type air fuel ratio controlling system comprising:

an exhaust gas sensor for supplying a sensor signal representative of an air fuel ratio;

an automatic gain control DC level amplifier having a gain which changes at a predetermined time constant in response to the output signal of said sensor, said amplifier including a variable gain DC level amplifier circuit having a signal input, an output, and a control input for controlling its gain, the signal input coupled to the output of said exhaust gas sensor, a comparator having a first input coupled to the output of said variable gain amplifier circuit and a second input being adapted to be coupled to a first predetermined reference voltage Vs and producing a first signal whenever the output of said variable gain amplifier is greater than Vs and a second signal whenever the output of said variable gain amplifier is less than Vs, and an integrator coupling the output of said comparator to said control input of said amplifier circuit for decreasing or increasing the gain of said amplifier circuit in response to said first or second signal, respectively, of said comparator at said predetermined time constant;

a lean-rich detector circuit for comparing the decreased or increased output of said amplifier circuit with a second predetermined reference voltage Vp to produce a detection signal representing a lean or rich state of air fuel ratio; and an actuator for controlling the air fuel ratio to stoichiometric ratio in response to the detection signal;

whereby when the sensor signal changes in accordance with said predetermined time constant, said decreased or increased output of said amplifier provides a hysteresis characteristic to said lean-rich detector between increase or decrease of the sensor output signal in order to cause an earlier detection of a lean to rich change and a rich to lean change of the air fuel ratio in order to cause a corresponding earlier control of the air fuel ratio by said actuator.

12. An air fuel ratio controlling system comprising:

an exhaust gas sensor for supplying a sensor signal representative of an air fuel ratio;

a deviation detector for comparing a signal representative of said sensor signal with a fixed reference level Vp representing a desired air fuel ratio to produce a deviation signal indicating a difference between an air fuel ratio sensed by said sensor and said desired air fuel ratio;

an actuator for controlling the air fuel ratio in response to the deviation signal; and an automatic gain control (AGC) DC level amplifier, coupled between said exhaust gas sensor and said deviation detector, for receiving said sensor signal and providing an amplified signal to said deviation detector, said AGC DC level amplifier having a DC response to the sensor signal for maintaining said amplified signal at a predetermined nominal DC level, and having an AC response to the output signal of said sensor so as to (a) change its gain in a first direction when said amplified signal is greater than a second predetermined reference level Vs and change its gain in a second direction when said amplified signal is less than Vs, whereby both rich to lean and lean to rich changes of air fuel ratio are detected earlier than they would be in the absence of such gain changes.

13. An air fuel ratio controlling system according to claim 12, wherein said AGC DC level amplifier comprises, a variable gain DC amplifier having a signal input coupled to said sensor signal, an output, and a control input for controlling its gain;

a comparator having a first input coupled to the output of said variable gain DC amplifier and a second input coupled to said second reference level Vs, said comparator for comparing said amplified signal to said second reference level, Vs and providing a comparator signal indicative thereof; and an integrator coupling the output of said comparator to said control input of said variable gain DC amplifier.

14. An air fuel ratio controlling system according to either of claims 12 or 13 wherein said fixed reference level Vp represents a stoichiometric air fuel ratio.

15. An air fuel ratio controlling system according to either of claims 12 or 13, wherein said first direction represents a decrease in gain and wherein said second direction represents an increase in gain.

16. An air fuel ratio controlling system according to either of claims 12 or 13, wherein said second predetermined reference level is selected from a range of 0.8 $Vs \leqq Vp \leqq 0.9$ Vs.

17. In a feedback type air fuel ratio controlling system comprising an exhaust gas sensor for supplying a sensor signal representative of air fuel ratio, a deviation detector circuit for comparing the sensor signal with a fixed reference signal Vp, representing a stoichiometric air fuel ratio, to produce a correcting signal, and an air fuel ratio correcting circuit responsive to the correcting signal, the improvement comprising:

an automatic gain control (AGC) DC level amplifier, coupled between said exhaust gas sensor and said deviation detector circuit, for receiving said sensor signal and providing an amplified signal to said deviation detector circuit, said AGC DC level amplifier having a DC response to the sensor signal for maintaining said amplified signal at a predetermined nominal DC level, and having an AC response to the output signal of said sensor so as to (a) change its gain in a first direction when said amplified signal is greater than a second predetermined reference level Vs and change its gain in a second direction when said amplified signal is less than Vs, whereby both rich to lean and lean to rich changes of air fuel ratio are detected earlier than they would be in the absence of such gain changes.

18. An improvement according to claim 17, wherein said AGC DC level amplifier comprises:

a variable gain DC amplifier having a signal input coupled to said sensor signal, an output, and a control input for controlling its gain;

a comparator having a first input coupled to the output of said variable gain DC amplifier and a second input adapted to be coupled to a second fixed reference signal Vs, said comparator for comparing said amplified signal to said second reference signal Vs and providing a comparator signal indicative thereof; and an integrator coupling the output of said comparator to said control input of said variable gain DC amplifier.

19. An improvement according to either of claims 17 or 18 wherein said fixed reference level Vp represents a stoichiometric air fuel ratio.

20. An improvement according to either of claims 17 or 18, wherein said first direction represents a decrease in gain and wherein said second direction represents an increase in gain.

21. An improvement according to either of claims 17 or 18, wherein said second predetermined reference level is selected from a range of 0.8 Vs Vp 0.9 Vs.

* * * * *